US005291376A

United States Patent [19]

Mills

[11] Patent Number: 5,291,376

[45] Date of Patent: Mar. 1, 1994

[54] SYSTEM FOR COUPLING A HIGH VOLTAGE, HIGH CURRENT WIRE TO A CIRCUIT BOARD

[75] Inventor: James M. Mills, Lexington, Ky.

[73] Assignee: Texas Instruments Incorporated, Dallas, Tex.

[21] Appl. No.: 31,764

[22] Filed: Mar. 15, 1993

[51] Int. Cl.[5] ..... H01R 9/00

[52] U.S. Cl. ..... 361/823; 361/752; 361/760; 361/807; 174/52.4; 439/709; 439/715

[58] Field of Search ..... 361/736, 729, 760, 761, 361/752, 796, 794, 807, 823, 772, 600; 439/709, 715, 716; 174/52.4, 17 R

[56] References Cited

U.S. PATENT DOCUMENTS

| | | | |
|---|---|---|---|
| 2,907,977 | 4/1955 | Daley | 339/272 |
| 4,700,271 | 10/1987 | Iio et al. | 361/355 |
| 4,811,168 | 3/1989 | Chesnut et al. | 361/399 |
| 4,924,213 | 5/1990 | Decho et al. | 340/653 |

*Primary Examiner*—Leo P. Picard
*Assistant Examiner*—Young Whang
*Attorney, Agent, or Firm*—Russell E. Baumann; Richard L. Donaldson; Rene' E. Grossman

[57] ABSTRACT

Circuit board terminals suitable for coupling high voltage, high current wires, such as 240 volts, 50 amps, to a circuit board is shown in which for each wire a block 24 of electrically conductive material is formed with a pair of ribs 48, 50 which interfit with a corresponding pair of slots 54, 56 in the circuit board 12. A bore 40 formed through the block from one sidewall to an opposed sidewall is adapted to receive the high voltage, high current wire which is clamped against the block by a set screw 44 received in a threaded bore 42 which communicates with the bore extending between the sidewalls. Another threaded member 60 is received through a bore 58 in the circuit board disposed between the two slots and into a threaded bore 62 in the bottom of the block disposed on one side of the circuit board with the head 62 of the threaded member engaging the high voltage, high current trace 22 or 14 on the opposite side of the circuit board. A layer of solder 68 is then placed over the head and onto the trace.

8 Claims, 2 Drawing Sheets

SYSTEM FOR COUPLING A HIGH VOLTAGE, HIGH CURRENT WIRE TO A CIRCUIT BOARD

BACKGROUND OF THE INVENTION

This invention relates generally to electric circuit boards and more specifically to circuit boards having high voltage, high current, such as 240 volts, 50 amps, traces thereon.

It is conventional to have high voltage, high current lines directly connected to relays and to use a relatively low voltage, low current signal to effect energization of the relay and concomitantly energize or de-energize the high voltage, high current lines. By way of example, in switching loads such as those used for residential heating, high voltage, high current lines are connected through relays to banks of electric heaters with the relays energized by appropriate low voltage signals from a thermostat or the like.

A control system for energizing and de-energizing electric heater banks along with associated components such as a fan, in which high voltage, high current lines are directly coupled to traces on a circuit board and to relays mounted on the board is shown in copending application Ser. No. 07/886,274 assigned to the assignee of the present invention. In that application a method and apparatus is disposed in which extended relay contact life is obtained by using a microprocessor, reading the AC input signals when the wave is at a peak, generating an output from the microprocessor to a relay at a time equal to a delay following a zero crossing of the AC line current wave so that contact engagement occurs in the proximity of zero crossing of the AC line current. This near zero crossing of the AC line current is conducive to providing the high voltage, high current traces directly on the board for connection with the relays.

SUMMARY OF THE INVENTION

It is an object of the present invention to provide a reliable coupling between a high voltage, high current wire and a trace on a circuit board. Another object is the provision of such a coupling which has improved capability for withstanding torque placed upon it when connecting a wire thereto.

Briefly, in accordance with the invention, a block of electrically conductive material is provided for each high voltage, high current trace disposed on the circuit board to which it is desired to couple a high voltage, high current line, the block being formed with a bore laterally extending between opposed sides of the block and being adapted to receive therethrough a high voltage, high current wire. A first threaded bore extends from a surface of the block to the laterally extending bore and is adapted to receive a set screw in order to clamp the wire against the body of the block. The block is formed with a seat which includes at least one portion extending downwardly from the block which is adapted to be received in a mating aperture in the circuit board. In the described embodiment a pair of parallel extending ribs depend downwardly from the bottom surface of the block and are received in a mating pair of slots formed in the circuit board. A second threaded bore is formed in the bottom surface of the block between the pair of ribs and a corresponding bore is formed in the circuit board between the pair of slots so that when the block is placed on a first side of the circuit board with the ribs received in the slots, an electrically conductive threaded member can be inserted through the bore into threaded engagement with the second threaded bore with a radially extending head of the threaded member engaging a trace on the second side of the board. According to a feature of the invention a quantity of solder is then placed over the radially extending head and onto the trace to enhance the current carrying capability thereof.

Various additional objects and advantages of the present invention will become apparent from the following detailed description and accompanying drawings.

BRIEF DESCRIPTION OF THE DRAWINGS

In the accompanying drawings in which the preferred embodiment of the invention is illustrated.

Figure 1:
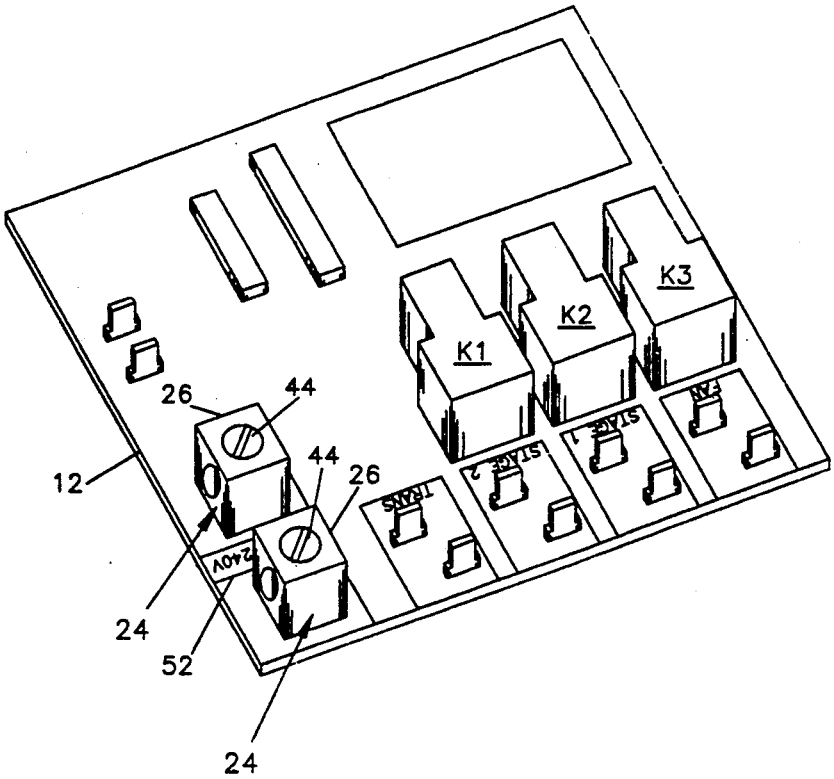
FIG. 1 is a perspective top view of a circuit board system made in accordance with the invention.

Dimensions of certain parts as shown in the drawings may have been modified or exaggerated for the purpose of clarity of illustration.

DESCRIPTION OF PREFERRED EMBODIMENTS

Turning now to the drawings, a system for coupling high voltage, high current wires to a circuit board comprises a circuit board 12 formed of conventional electrically insulative material having a suitable thickness, typically between 0.045 and 0.062 inches. The particular board shown is intended for use in the control of a heating system such as the type described in application Ser. No. 07/886,274 referenced supra, although the invention is applicable to any circuit board having a trace or conductive path to which it is desired to couple a high voltage, high current wire. Board 12 includes a plurality of relays K1, K2, K3 adapted upon energization to close or open circuit paths between traces 14, 16, 18, 20 and common trace 22. Relays K1, K2, K3 are controlled by low voltage signals provided by other components mounted on circuit board 12 which are not relevant to the coupling system of the invention and therefore will not be further described herein.

Figure 3:
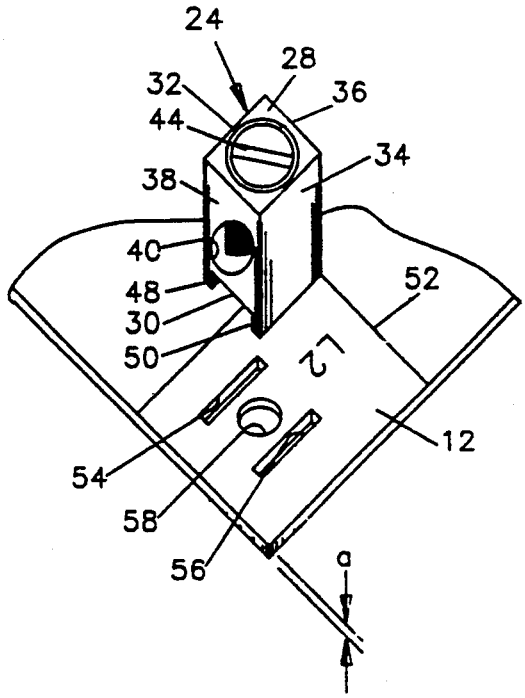
FIG. 3 is a perspective top view of a coupling block and a portion of a circuit board having a coupling block seat shown with the coupling block spaced above the seat.

As shown in FIG. 1, a coupling system 24 comprises a block 26 formed of suitable electrically conductive material generally in the shape of a parallelepiped having, as seen in FIG. 3, an upper surface 28, a lower surface 30 and opposed pairs of sidewalls 32, 34 and 36, 38 respectively. Block 26 is formed with a bore 40 laterally extending between a pair of sidewalls 36, 38 and is adapted to receive therethrough a high voltage, high current wire (not shown). A first threaded bore 42 (FIG. 4) extends from the top surface 28 into communication with laterally extending bore 40 and is adapted to receive a suitable set screw 44 having a generally convex lower distal end 46 adapted to clamp a wire inserted through bore 40 against the lower surface of the body of the block defining bore 40.

A pair of generally parallel extending rib members 48, 50 depend downwardly from sidewalls 32, 34, a distance b (FIG. 4) below lower surface 30 of block 24. Distance b is preferably selected to be less than distance a, the thickness of circuit board 12, shown in FIG. 3.

Figure 4:
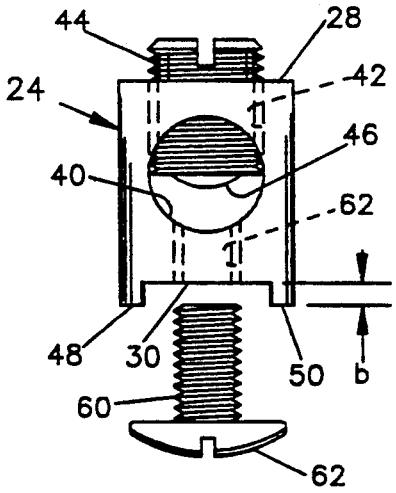
FIG. 4 is an elevational view of the coupling block shown in FIGS. 1 and 3.

Circuit board 12 is formed with a seat located on an area of the board demarked by line 52 which comprises a pair of parallel extending slots 54, 56 respectively adapted to receive ribs 48, 50 therein. A bore 58 is formed through circuit board 12 between slots 54, 56 and is adapted to receive a threaded member, screw 60, therethrough (FIG. 4). Block 24 is formed with a second threaded bore 62 adapted to receive screw 60. Bore 62 is shown to extend to and communicate with laterally extending bore 40; however, if desired, it could be closed ended terminating below the bore. Block 24 is installed by placing it on one side of circuit board 12, as seen in FIG. 3, with ribs 48, 50 received respectively in slots 54, 56 and screw 60 is inserted through bore 58 of board 12 from the opposite side of the board and into threading engagement with second threaded bore 62. Screw 60 is formed of electrically conductive material and has an outwardly radially extending head 62 which is brought into engagement with trace 22 on the circuit board as shown at 64 in FIG. 2.

Figure 2:
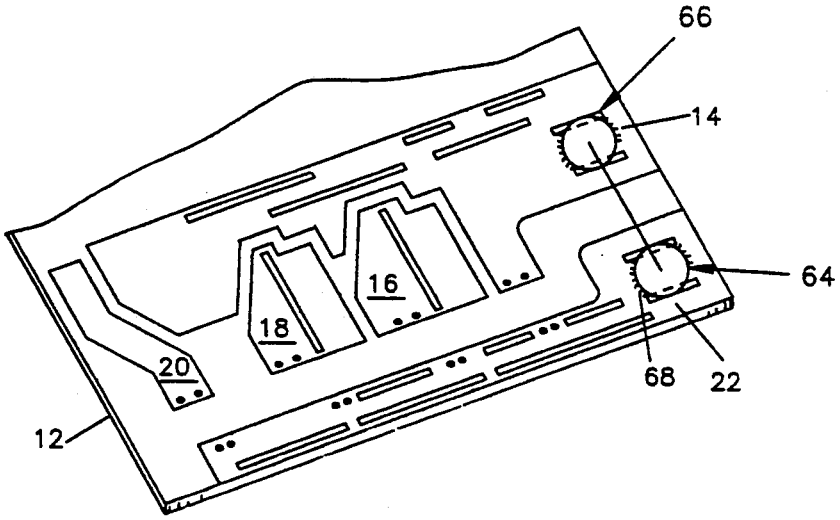
FIG. 2 is a perspective bottom view of a portion of the FIG. 1 circuit board system.

Another block 24 is mounted in the same manner so that the head of corresponding screw is brought into engagement with trace 14 on the circuit board as shown at 66 in FIG. 2. The screw heads shown at 64 and 66 are then preferably covered with a selected quantity of solder 68 which extends onto traces 22, 14 as well, to enhance the current carrying capability thereof.

Block 24 formed of suitable material, such as aluminum, may be plated with tin, e.g., 0.0001–0.0004 inches over a copper layer, e.g., 0.00005–0.00012 inches to enhance long term electrical conductivity, if desired.

Use of the downwardly depending ribs and mating slots in the circuit board greatly increases the couplings ability to withstand torque subjected, for example, when set screw 44 is tightened onto a wire received in laterally extending bore 40 and enables the system to exceed 45 inch pounds of torque required by accepted standards for high voltage, high current couplings.

It will be understood that although a pair of parallel extending ribs are shown, other downwardly depending portions could be used along with mating apertures in the circuit board to provide the required torque resistance, such as short L shape ribs formed at each corner of block 24. Further, although the first threaded bore 42 is shown extending from the top surface 28, the bore could extend from sidewall 34 or 32 to laterally extending bore 40, if desired.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

I claim:

1. A circuit board system for coupling a high voltage, high current wire to a trace on the circuit board comprising a circuit board having first and second opposed faces and having a high voltage, high current circuit portion including at least one electrically conductive trace on the first face, a terminal for coupling a high voltage, high current wire to the at least one trace comprising a block of electrically conductive material, the block formed generally as a parallelepiped having upper and lower surfaces, and two pairs of opposed sidewalls, a laterally extending bore formed between two opposed sidewalls of a pair, a first threaded bore extending from a surface into communication with the laterally extending bore, a second threaded bore extending from the lower surface into the block, the block having at least one portion depending downwardly from the lower surface, a first threaded member received in the first bore and being adapted to clamp a wire received in the laterally extending bore, a second threaded member formed of electrically conductive material and being formed with a head extending radially therefrom, the circuit board having a bore extending between the first and second faces and being adapted to receive the second threaded member therethrough, the second threaded member being threadingly received in the second threaded bore to attach the block to the second face of the board, and an aperture for each downwardly extending portion extending between the first and second faces and aligned with and receiving therein each respective downwardly depending portion when the second threaded member is disposed in the second threaded bore, the head engaging the at least one electrically conductive trace on the first face of the board forming an electrical coupling from the wire through the block, the second threaded member and the head thereof to the at least one trace.

2. The circuit board system according to claim 1 in which the at least one portion depending downwardly from the lower surface comprises a pair of parallel extending ribs.

3. The circuit board system according to claim 1 in which the circuit board has a selected thickness and the at least one portion depending downwardly from the lower surface extends from the lower surface a distance less than the selected thickness.

4. The circuit board system according to claim 1 in which the circuit board has a selected thickness and the at least one portion depending downwardly from the lower surface comprises a pair of parallel extending ribs which extend from the lower surface a distance less than the selected thickness.

5. The circuit board system according to claim 1 further including solder disposed over the head and onto the trace.

6. The circuit board system according to claim 1 in which the at least one portion depending downwardly from the lower surface can withstand at least 45 inch pounds of torque placed on the block through the first threaded member.

7. The circuit board system according to claim 1 in which there are at least two high voltage, high current traces and there is an electrically conductive block having at least one portion depending downwardly from the lower surface for each trace.

8. The circuit board system according to claim 1 in which the first threaded bore extends from the upper surface of the block into communication with the laterally extending bore.

* * * * *